US011649697B2

(12) United States Patent
Larsen et al.

(10) Patent No.: US 11,649,697 B2
(45) Date of Patent: May 16, 2023

(54) METHOD AND APPARATUS FOR CLEANING A WELLBORE

(71) Applicants: Adam Larsen, Spring, TX (US); Fernando Javier Parra Ferrer, Fulshear, TX (US); Hernando Andres Garcia Silva, Cypress, TX (US)

(72) Inventors: Adam Larsen, Spring, TX (US); Fernando Javier Parra Ferrer, Fulshear, TX (US); Hernando Andres Garcia Silva, Cypress, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 100 days.

(21) Appl. No.: 17/128,987

(22) Filed: Dec. 21, 2020

(65) Prior Publication Data

US 2022/0195845 A1 Jun. 23, 2022

(51) Int. Cl.

| | |
|---|---|
| ***E21B 37/00*** | (2006.01) |
| ***E21B 41/00*** | (2006.01) |
| ***E21B 37/04*** | (2006.01) |

(52) U.S. Cl.

CPC ..... *E21B 37/00* (2013.01); *E21B 37/04* (2013.01); *E21B 41/0078* (2013.01)

(58) Field of Classification Search

CPC ..... E21B 37/00; E21B 34/06; E21B 41/0078; E21B 37/04; E21B 31/08; E21B 31/00; E21B 34/00; E21B 43/00; E21B 4/38; F04F 5/00

See application file for complete search history.

(56) References Cited

U.S. PATENT DOCUMENTS

| | | | | |
|---|---|---|---|---|
| 4,187,921 | A | 2/1980 | Garner | |
| 2011/0024119 | A1 | 2/2011 | Wolf et al. | |
| 2012/0048569 | A1 | 3/2012 | Williams | |
| 2012/0118571 | A1 | 5/2012 | Zhou | |
| 2013/0341017 | A1 | 12/2013 | Xu et al. | |
| 2015/0226046 | A1* | 8/2015 | Wolf | F04C 13/00 166/372 |
| 2018/0238143 | A1* | 8/2018 | Falk | E21B 37/00 |
| 2019/0048247 | A1* | 2/2019 | Pernites | E21B 33/14 |

OTHER PUBLICATIONS

Notification of the International Search Report and Written Opinion; PCT/US2021/063304; Korean Intellectual Property Office; dated Apr. 11, 2022; 10 pages.

* cited by examiner

*Primary Examiner* — Yong-Suk (Philip) Ro
(74) *Attorney, Agent, or Firm* — Cantor Colburn LLP

(57) ABSTRACT

An apparatus performs a method for cleaning a wellbore. The apparatus is a jet sub including an engine, a flow diverter and mixing throat. The engine propels a driving fluid at a first end of the jet sub towards a second end of the jet sub along a longitudinal axis of the jet sub. The flow diverter redirects the driving fluid by a redirection angle that is an obtuse angle. The mixing throat receives a mixed fluid including the driving fluid from the flow diverter and induced fluid drawn into the mixing throat by the driving fluid. The mixed fluid is injected into an annulus of the wellbore at the obtuse angle.

13 Claims, 2 Drawing Sheets

METHOD AND APPARATUS FOR CLEANING A WELLBORE

BACKGROUND

In the resource recovery industry, a production string is lowered into a wellbore to a selected downhole location in order to draw hydrocarbons from a formation at the downhole location and deliver the hydrocarbons to a surface location. During production, sand and debris can accumulate in the wellbore, thereby reducing the effectiveness of the production operation. Cleaning the wellbore of the sand and debris can increase the production operation back to its initial levels or production. Cleaning the wellbore is facilitated by creating pressure differentials in the wellbore that generate fluid circulation in the wellbore for vacuuming the wellbore. Energy expenditure in vacuuming the wellbore is of concern. The art is therefore receptive to energy-efficient production of pressure differentials in a wellbore.

SUMMARY

Disclosed herein is a method of cleaning a wellbore. A driving fluid at a first end of a jet sub in a wellbore is directed, via an engine of the jet sub, towards a second end of the jet sub along a longitudinal axis of the jet sub. The driving fluid is redirected from the longitudinal axis by a redirection angle at a flow diverter of the jet sub, wherein the redirection angle is an obtuse angle. The driving fluid is mixed with an induced fluid in a mixing throat of the jet sub to form a mixed fluid, wherein the mixed fluid is injected into an annulus of the wellbore at the obtuse angle.

Also disclosed herein is an apparatus for cleaning a wellbore. The apparatus includes a jet sub including an engine for propelling a driving fluid at a first end of the jet sub towards a second end of the jet sub along a longitudinal axis of the jet sub; a flow diverter configured to redirect the driving fluid by an redirection angle, wherein the redirection angle is an obtuse angle to the longitudinal axis; and a mixing throat that receives a mixed fluid including the driving fluid from the flow diverter and induced fluid drawn into the mixing throat by the driving fluid, wherein the mixed fluid is injected into an annulus of the wellbore at the obtuse angle.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
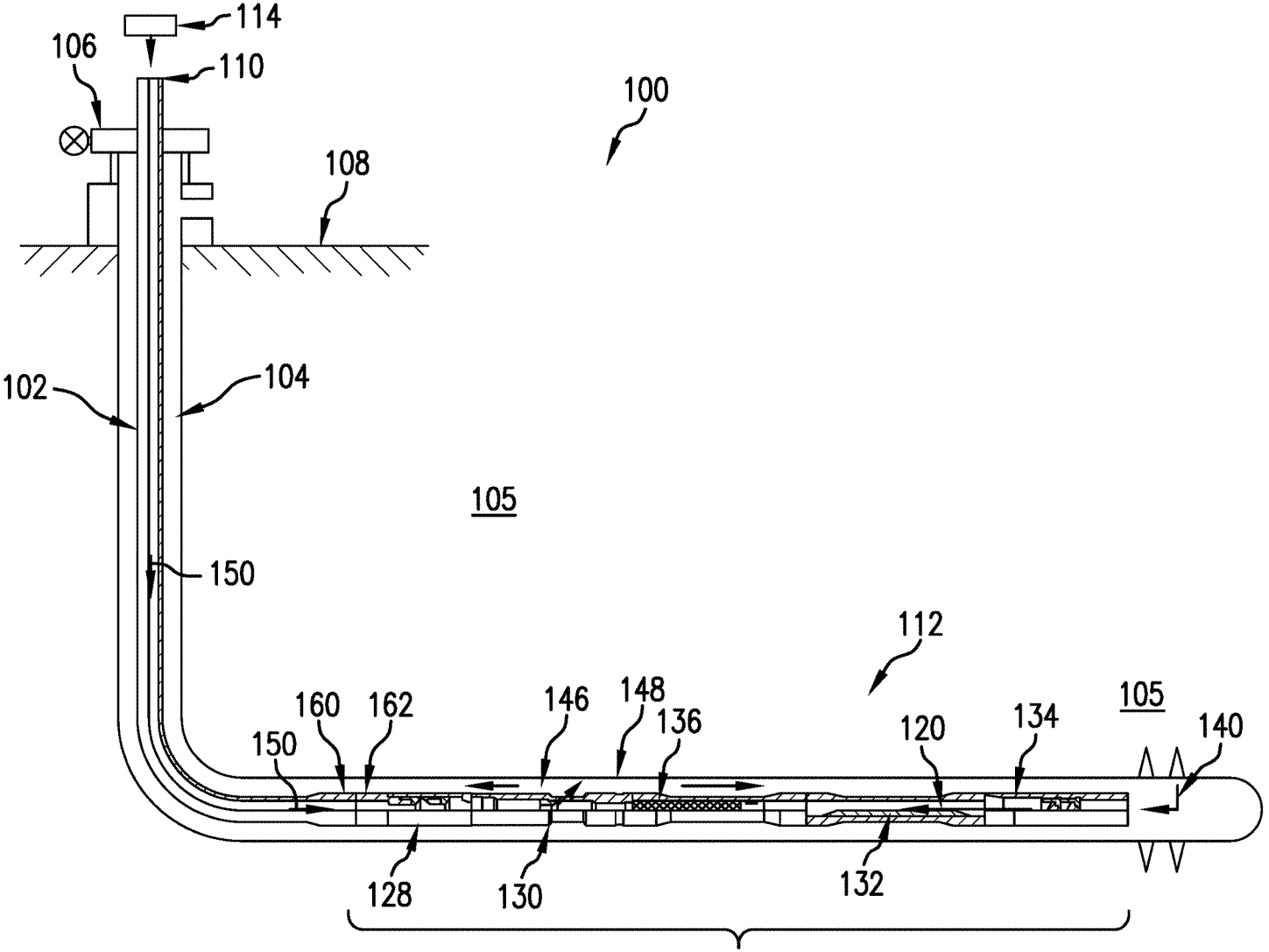
FIG. 1 shows a wellbore cleaning system in an embodiment.

Referring to FIG. 1, a wellbore cleaning system 100 is shown in an embodiment. The wellbore cleaning system 100 includes a string 102 that is disposed in a wellbore 104 in a formation 105. The string 102 extends into the wellbore 104 from a well head 106 at a remote location 108, such as a surface location, to a downhole location 112 in the wellbore

104. The well head 106 includes a port 110. During a cleaning process, cleaning equipment (not shown) can be attached to the port 110 to pump a driving fluid 150 into the wellbore 104 via the interior of the string 102. The driving fluid 150 can be a cleaning fluid suitable for cleaning the wellbore 104. A control unit 114 can be used to control various operations of the wellbore cleaning system 100, such as a pressure of the driving fluid 150, etc.

A cleaning assembly 124 is coupled to a bottom end of the string 102. The cleaning assembly 124 can be coupled via a threading attachment between a first threaded pipe 160 to of the string 102 and a second threaded pipe 162 of the cleaning assembly 124.

In various embodiments, the cleaning assembly 124 includes a top float valve 128, a jet sub 130, a debris chamber 132 and a bottom float valve 134. The top float valve 128 is at a bottom end of the string 102 and the jet sub 130 is between the top float valve 128 and the debris chamber 132. The bottom float valve 134 is affixed to a bottom or downhole end of the debris chamber 132. The debris chamber 132 includes a debris screen 136 that filters debris from a fluid flowing through the debris chamber 132. The top float valve 128 allows flow of fluid in only one direction (i.e., in a downhole direction) from the string 102 to the jet sub 130. The bottom float valve 134 allows flow of the fluid in only one direction (i.e., into the debris chamber 132 from the wellbore 104).

To clean debris from the wellbore 104, the driving fluid 150 is pumped downhole from the well head 106 through the interior of the string 102. The driving fluid 150 passes into the top float valve 128 and to the jet sub 130. The driving fluid 150 is injected into the wellbore 104 through ports in the jet sub 130 and flows into an annulus 146 between the debris chamber 132 and a wall 148 of the wellbore 104. By circulating through the annulus 146, the driving fluid 150 creates a circulation of fluid (referred to hereinafter as "induced fluid 120") traveling from the from the jet sub 130 to the bottom float valve 134 in the annulus 146 uphole through the debris chamber 132. The induced fluid 120 picks up the debris in the wellbore 104 and transports the debris through the bottom float valve 134 and into the debris chamber 132. The induced fluid 120 flows through the debris chamber 132 and the debris screen 136 at an uphole end of the debris chamber 132 separates the debris out of the induced fluid 120, thereby collecting the debris in the debris chamber 132. The induced fluid 120, now free of debris, can be circulated back into the wellbore 104 via the jet sub 130, as discussed with respect to FIG. 2.

Figure 2:
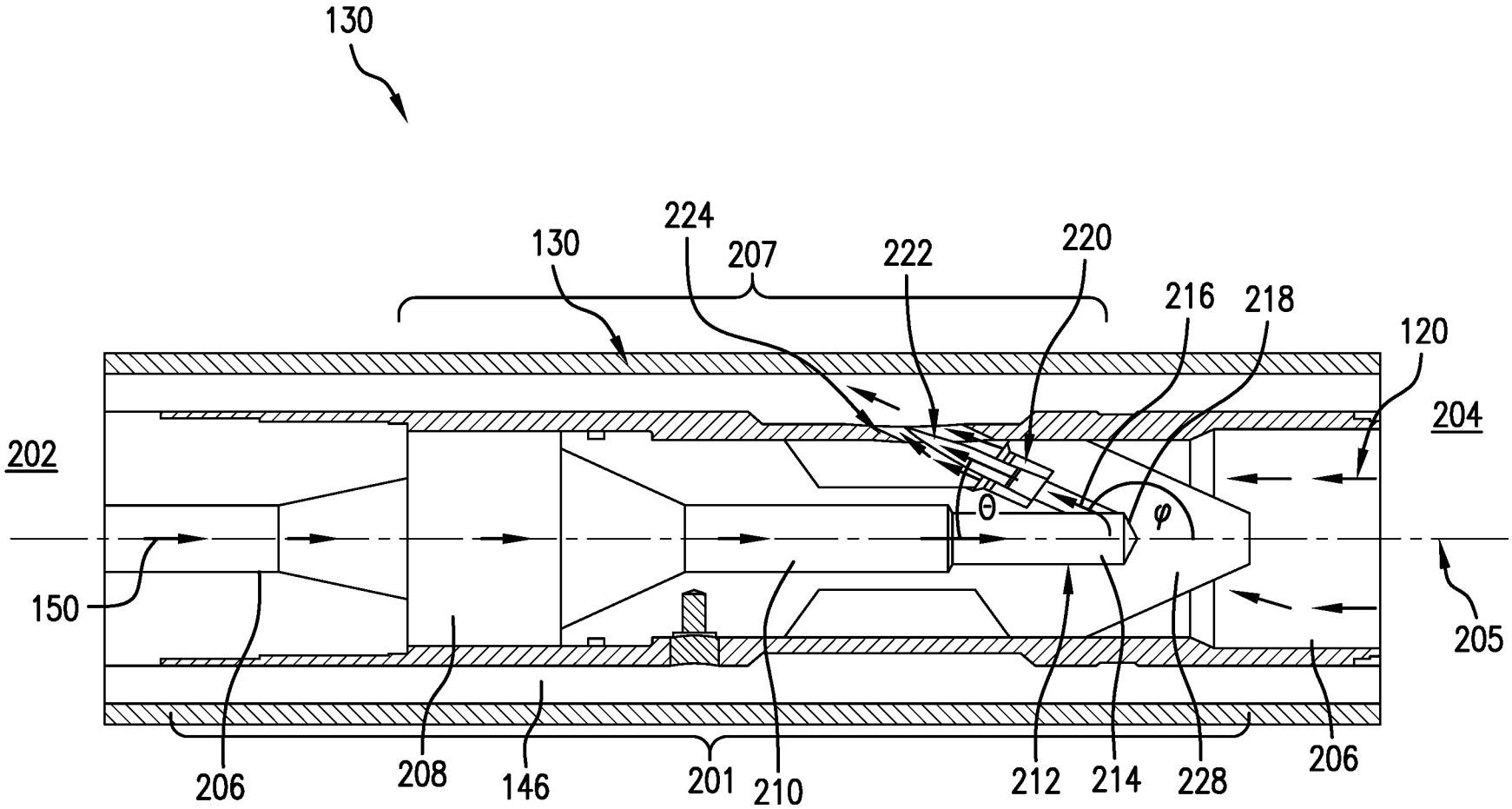
FIG. 2 shows a detailed illustration of a jet sub of the wellbore cleaning system, in an embodiment.

FIG. 2 shows a detailed illustration of the jet sub 130 of the wellbore cleaning system 100, in an embodiment. The jet sub 130 includes a jet body 201 that extends from a first end 202 to a second end 204 along a longitudinal axis 205. The first end 202 is generally an uphole end attached to the string 102 or top float valve 128. The second end 204 is generally a downhole end attached to the cleaning assembly 124. When disposed within the wellbore 104, the longitudinal axis 205 is parallel or substantially parallel to a longitudinal axis of the wellbore 104. The jet sub 130 injects fluids at high velocities into the annulus 146 in order to create a pressure differential in the jet sub 130 to circulate fluids in the annulus 146 and through the debris chamber 132.

The jet body 201 a jet engine 207 having an inlet 208, an outlet 210 and a flow diverter 212. A power fluid outlet 206 at an end of string 102 is coupled to the inlet 208 to allow the driving fluid 150 from the string 102 into the jet engine 207. In various embodiments, jet engine 207 propels the driving fluid 150 through the outlet 210 and flow diverter 212. The outlet 210 serves, in part, as a nozzle carrier that supports the flow diverter 212. The driving fluid 150 is received at the jet sub 130 at the inlet 206 at the first end 202 and is propelled at high velocities in a first direction (toward the second end 204 along the longitudinal axis 105) through the outlet 210 and into the flow diverter 212. The flow diverter 212 includes a first arm 214 and a second arm 216 connected at an elbow 218. The second arm 216 includes a motive nozzle 220 for expelling the driving fluid 150 from the flow diverter 212. The second arm 216 is angled with respect the first arm 214 at an arm angle θ, which is an acute angle. In one embodiment, the arm angle θ is 30 degrees. In another embodiment, the arm angle is between 25 degrees and 45 degrees. In yet another embodiment, the arm angle is between 20 degrees and 90 degrees.

The first arm 214 is aligned along the longitudinal axis 205 and directs the driving fluid 150 in the first direction toward the second end 204. With the first arm 214 directed along the longitudinal axis 205, the elbow 218 and second arm 216 redirect the driving fluid 150 by a redirection angle φ which is an obtuse angle that is a supplementary angle to the acute angle θ. In one embodiment, the redirection angle φ is about 150 degrees. In another embodiment, the redirection angle is in a range between about 135 degrees and about 155 degrees. In yet another embodiment, the redirection angle is in a range between about 90 degrees and about 160 degrees.

The driving fluid 150 flows through the first arm 214. The elbow 218 redirects the driving fluid 150 into the second arm 216. The driving fluid 150 then flows through the second arm 216 along a second direction that is at the angle of direction φ with respect to the first direction. The driving fluid 150 exits the second arm 216 via the motive nozzle 220 in the form of a fluid jet 222. The fluid jet 222 is directed into a mixing throat 224.

The jet sub 130 also includes a suction inlet 226 that receives the induced fluid 120 from the cleaning assembly 124. The induced fluid 120 flows from the suction inlet 226 into a chamber 228 between the engine 207 and suction inlet 226. At least a portion of the flow diverter 212 resides with the chamber 228. The high velocity of the fluid jet 222 exiting the second arm 216 creates a low-pressure zone in the jet sub 130 that draws the induced fluid 120 into the mixing throat 224, where the driving fluid 150 and induced fluid 120 can combine to form a mixed fluid. The mixing throat 224 provides an outlet into the annulus 146 and is generally oriented to allow the fluid jet 222 to be directed along the second direction and to travel in an uphole direction within the annulus 146. The high velocity of the mixed fluid creates a low pressure zone in the jet sub 130 at the top end of the cleaning assembly 124. The mixed fluid separates in the annulus 146 into a first current traveling uphole toward the surface and a second current travelling downhole toward the bottom end of the cleaning assembly 124. When it reaches the surface, the fluid in the first current can be redirected downhole as the driving fluid 150. The second current is induced by the pressure differential to circulate down the annulus 146 from the jet sub 130 to the bottom end of the cleaning assembly 124 and then up through the interior of the cleaning assembly 124, returning to the jet sub 130 as the induced fluid 120.

The obtuse redirection angle of the flow diverter 212 places the second arm of the flow diverter 212 in a substantially same direction of the induced fluid 120 entering into the chamber 228 via the suction inlet 226. Therefore, the direction flow of the induced fluid 120 in the chamber 228 is relatively unchanged with respect to the direction of flow of the induced fluid within the cleaning assembly 124 and the debris chamber 132. The result of diverting the driving fluid 150 through the obtuse redirection angle is a reduction in the energy required to create a flow of the induced fluid 120, thereby increasing circulation speeds in comparison to a circulation caused by a driver fluid 150 ejected at an acute redirection angle and increasing suction efficiency of the cleaning assembly 124.

Set forth below are some embodiments of the foregoing disclosure:

Embodiment 1: A method of cleaning a wellbore. The method includes directing, via an engine of a jet sub in the wellbore, a driving fluid at a first end of the jet sub towards a second end of the jet sub along a longitudinal axis of the jet sub; redirecting the driving fluid from the longitudinal axis by a redirection angle at a flow diverter of the jet sub, wherein the redirection angle is an obtuse angle; and mixing the driving fluid with an induced fluid in a mixing throat of the jet sub to form a mixed fluid, wherein the mixed fluid is injected into an annulus of the wellbore at the obtuse angle.

Embodiment 2: The method of any prior embodiment, wherein the first end of the jet sub is uphole of the second end of the jet sub.

Embodiment 3: The method of any prior embodiment, wherein the obtuse angle is one of: (i) about 150 degrees; (ii) in a range between about 135 degrees and about 155 degrees; and (iii) in a range between about 90 degrees and about 160 degrees.

Embodiment 4: The method of any prior embodiment, wherein redirecting the driving fluid by the obtuse angle creates a low pressure zone in the jet sub.

Embodiment 5: The method of any prior embodiment, wherein the flow diverter has a first arm and a second arm forming an arm angle with the first arm, the arm angle being supplementary to the redirection angle.

Embodiment 6: The method of any prior embodiment, wherein the mixed fluid separates in the annulus into a first current flowing in an uphole direction and a second current flowing in a downhole direction.

Embodiment 7: The method of any prior embodiment, wherein the second current flows in the downhole direction through the annulus and flows uphole through an interior of a cleaning assembly.

Embodiment 8: The method of any prior embodiment, wherein the longitudinal axis of the jet sub is substantially parallel to the longitudinal axis of the wellbore.

Embodiment 9: An apparatus for cleaning a wellbore. The apparatus includes a jet sub including an engine for propelling a driving fluid at a first end of the jet sub towards a second end of the jet sub along a longitudinal axis of the jet sub; a flow diverter configured to redirect the driving fluid by an redirection angle, wherein the redirection angle is an obtuse angle to the longitudinal axis; and a mixing throat that receives a mixed fluid including the driving fluid from the flow diverter and induced fluid drawn into the mixing throat by the driving fluid, wherein the mixed fluid is injected into an annulus of the wellbore at the obtuse angle.

Embodiment 10: The apparatus of any prior embodiment, wherein the obtuse angle is one of: (i) about 150 degrees; (ii) in a range between about 135 degrees and about 155 degrees; and (iii) in a range between about 90 degrees and about 160 degrees.

Embodiment 11: The apparatus of any prior embodiment, wherein the obtuse angle of the flow diverter enables creation of a low pressure zone in the jet sub.

Embodiment 12: The apparatus of any prior embodiment, wherein the flow diverter has a first arm and a second arm forming an arm angle with the first arm, the arm angle being supplementary to the redirection angle.

Embodiment 13: The apparatus of any prior embodiment, wherein the mixed fluid separates in the annulus into a first current flowing in an uphole direction and a second current flowing in a downhole direction.

Embodiment 14: The apparatus of any prior embodiment, wherein the second current flows in the downhole direction through the annulus and flows uphole through an interior of the cleaning assembly.

Embodiment 15: The apparatus of any prior embodiment, wherein the longitudinal axis of the jet sub is substantially parallel to the longitudinal axis of the wellbore.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A method of cleaning a wellbore, comprising:

directing, via an engine of a jet sub in the wellbore, a driving fluid at a first end of the jet sub towards a second end of the jet sub along a longitudinal axis of the jet sub;

redirecting the driving fluid from the longitudinal axis by a redirection angle at a flow diverter of the jet sub, wherein the redirection angle is an obtuse angle; and mixing the driving fluid with an induced fluid in a mixing throat of the jet sub to form a mixed fluid, wherein the mixed fluid is injected into an annulus of the wellbore at the obtuse angle, wherein the mixed fluid separates in the annulus into a first current flowing in an uphole direction and a second current flowing in a downhole direction.

2. The method of claim 1, wherein the first end of the jet sub is uphole of the second end of the jet sub.

3. The method of claim 1, wherein the obtuse angle is one of: (i) about 150 degrees; and (ii) in a range between about 135 degrees and about 155 degrees.

4. The method of claim 1, wherein redirecting the driving fluid by the obtuse angle creates a low pressure zone in the jet sub.

5. The method of claim 1, wherein the second current flows in the downhole direction through the annulus and flows uphole through an interior of a cleaning assembly.

6. The method of claim 1, wherein the longitudinal axis of the jet sub is substantially parallel to the longitudinal axis of the wellbore.

7. The method of claim 1, wherein the flow diverter has a first arm and a second arm connected to the first arm at an elbow and forming an arm angle with the first arm at the elbow, the arm angle being an acute angle that is supplementary to the redirection angle.

8. An apparatus for cleaning a wellbore, comprising:

a jet sub including an engine for propelling a driving fluid at a first end of the jet sub towards a second end of the jet sub along a longitudinal axis of the jet sub;

a flow diverter configured to redirect the driving fluid by a redirection angle, wherein the redirection angle is an obtuse angle to the longitudinal axis, wherein a mixed fluid separates in an annulus of the wellbore into a first current flowing in an uphole direction and a second current flowing in a downhole direction; and a mixing throat that receives the mixed fluid including the driving fluid from the flow diverter and induced fluid drawn into the mixing throat by the driving fluid, wherein the mixed fluid is injected into the annulus of the wellbore at the obtuse angle.

9. The apparatus of claim 8, wherein the flow diverter has a first arm and a second arm connected to the first arm at an elbow and forming an arm angle with the first arm at the elbow, the arm angle being an acute angle that is supplementary to the redirection angle.

10. The apparatus of claim 8, wherein the obtuse angle is one of: (i) about 150 degrees; and (ii) in a range between about 135 degrees and about 155 degrees.

11. The apparatus of claim 8, wherein the obtuse angle of the flow diverter enables creation of a low pressure zone in the jet sub.

12. The apparatus of claim 8, wherein the second current flows in the downhole direction through the annulus and flows uphole through an interior of a cleaning assembly.

13. The apparatus of claim 8, wherein the longitudinal axis of the jet sub is substantially parallel to the longitudinal axis of the wellbore.

* * * * *